US005810626A

United States Patent [19]

Heimueller et al.

[11] Patent Number: 5,810,626

[45] Date of Patent: Sep. 22, 1998

[54] PLUG CONNECTOR

[75] Inventors: Hans-Jost Heimueller, Dudenhofen; Michael Gib, Landau; Martin Straeb, Diessen, all of Germany; Joris Dobbelaere; Rony Van Houdenhove, both of Beernem, Belgium; Bart Kerckhof, Oostkamp, Belgium

[73] Assignee: Siemens Aktiengesellschaft, Munich, Germany

[21] Appl. No.: 791,624

[22] Filed: Jan. 31, 1997

[30] Foreign Application Priority Data

Jan. 31, 1996 [DE] Germany ..... 196 03 479.5

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,915,654 | 4/1990 | Zinn | 439/752 |
| 5,030,142 | 7/1991 | Hess et al. | 439/752 |
| 5,044,991 | 9/1991 | Colleran et al. | 439/752 |
| 5,624,284 | 4/1997 | Gib et al. | 439/752 |

FOREIGN PATENT DOCUMENTS

| | | | |
|---|---|---|---|
| 3330151 | 3/1985 | Germany | 439/752 |
| 35 37 722 | 4/1987 | Germany . | |
| 44 07 950 C1 | 8/1995 | Germany . | |

*Primary Examiner*—Gary F. Paumen
*Attorney, Agent, or Firm*—Herbert L. Lerner; Laurence A. Greenberg

[57] ABSTRACT

A plug connector has a housing of insulating material with at least one row of contact chambers into which contact elements can be inserted. The inserted contact elements can be secured with a securing slide which can be inserted orthogonally to a plugging direction of the plug connector into a gap of the housing. The securing slide has a primary detent edge orthogonally to the plugging direction of the plug connector, extending along two long sides of the securing slide and a segmented detent edge extending below the primary edge for secondary securing.

8 Claims, 3 Drawing Sheets

PLUG CONNECTOR

BACKGROUND OF THE INVENTION

Field of the Invention

The invention relates to a plug connector having a housing of insulating material with at least two parallel rows of contact chambers into which contact elements can be inserted, and a securing slide to be inserted orthogonally to a plugging direction of the plug connector into a gap in the housing, for securing the inserted contact elements.

Plug connectors are known, for instance, from German Published, Non-Prosecuted Patent Application DE 35 37 722 A1. In the plug connector housings described therein, in order to provide positional securing of the contact elements inserted into the various contact chambers, or in other words the male plug contacts in the case of male plug connectors and the female or bush contacts in the case of female or bush plug connectors, an intermediate land is provided in each case in an associated surrounding housing, and a securing edge is formed thereon that protrudes into every contact chamber upon insertion of the contact housing into the surrounding housing and thereby engages one edge of each of the contact elements from behind.

Increasingly, two independently acting securing principles are demanded, which necessitate special construction of both the male plug contacts and the female contacts.

Along with a so-called primary locking of the detent type, secondary securing of the plug contacts inside the male plug connector and of the female contacts inside the female plug connector is also demanded. Once the male or female contacts have been inserted into their respective housings (plug strips, relay sockets, etc.), which are typically formed of insulating material, detent elements engage corresponding openings of the housings and lock there in detent fashion.

Secondary securing is attained by providing that once the male or female plug housing has been equipped and the aforementioned primary locking of the male or female plug contacts has been accomplished, plastic elements are placed in a position in which they engage the contour of the contacts from behind. The plastic elements for the secondary securing are constructed in the form of slide devices, such as slide strips, which are inserted into the male or female plug connector orthogonally to the plugging direction and which, with one or more protruding lands, engage edges of the contacts inserted into the contact chambers of the housing from behind. Those securing slides, for safety reasons, can be inserted into the male plug connector housing or female plug connector only whenever the various contacts in their contact chambers are in the desired position. If one of the contacts has not been inserted completely, the securing slide cannot engage the contact from behind with its protruding contour, because it abuts against the contact, and insertion of the securing slide is thus impossible. A securing slide that cannot be inserted will be noticed during assembly, so that it is necessary to monitor the connection of the male or female plug connector to the various lines.

In most plug connectors, the securing slide until now has always been made in such a way that it only performs a single securing, namely the secondary securing of the contacts inserted into the contact chambers. Conversely, the primary securing of the contact elements is effected in especially constructed protrusions or recesses on the outer walls of the contact chambers, which are provided entirely in the plug connector.

German Published, Non-Prosecuted Patent Application DE 44 07 950 A1 has already described a plug connector with the capability of primary and secondary securing, in which a primary detent edge, cooperating for the primary securing with a first detent tongue of the contact element, is disposed on a fixed contact chamber wall. The opposite second contact chamber wall is constructed as a securing slide that is movable crosswise to the plugging direction and has a segmented and therefore interrupted detent edge so that a second detent tongue on the contact element can pass through it.

A problematic aspect of that construction is the compulsory presence of two detent tongues on the contact element which has to be inserted into the contact chamber of the plug connector housing.

SUMMARY OF THE INVENTION

It is accordingly an object of the invention to provide a plug connector, which overcomes the hereinafore-mentioned disadvantages of the heretofore-known devices of this general type, in which primary and secondary securing principles are realizable in a simple way and in which a contact element need only have a single detent tongue.

With the foregoing and other objects in view there is provided, in accordance with the invention, a plug connector, comprising a housing of insulating material having at least two parallel rows of contact chambers and having a gap formed therein; contact elements to be inserted into the contact chambers, the contact elements having detent hooks and contours; and a securing slide to be thrust into the gap for securing the inserted contact elements, the securing slide having two long sides, a multiplicity of detent protrusions disposed on at least one of the long sides orthogonally to a plugging direction of the plug connector for secondary detent securing, the detent protrusions engaging the contours from behind for secondary securing of the contours, the detent protrusions disposed side by side and mutually spaced apart for receiving one of the contact elements thrust between two of the secondary detent protrusions, and a primary detent edge on which the detent hooks rest and lock with the contact elements inserted into the contact chambers, the primary detent edge extending along the two long sides orthogonally to the plugging direction, the primary detent edge extending above and parallel to the detent protrusions. This has the advantage of ensuring that the contact elements can be easily inserted into the housing.

The secondary detent protrusions may engage contours or edges of the contact elements from behind for the purpose of providing secondary security for them. Upon displacement of the securing slide in the gap of the housing it is thus possible to assure both a primary securing and a secondary securing of the contact elements inserted into the contact chambers.

In accordance with another feature of the invention, the securing slide has wall portions at the contact chambers, and the securing slide has a multiplicity of auxiliary openings formed therein, oriented in the plugging direction and disposed between the wall portions.

In accordance with a further feature of the invention, the gap in the housing into which the securing slide is inserted has a bottom facing toward the plugging direction and the housing has a spring element in which the securing slide can be locked in detent fashion. This assures that the securing slide cannot easily slip out of the housing if the plug connector becomes skewed.

In accordance with an added feature of the invention, a groove is machined into the bottom of the gap in the housing, and a protrusion disposed on the lower surface or underside of the securing slide can be locked in the groove in detent fashion.

In accordance with an additional feature of the invention, in order to offer a defined predetent position and a defined final detent position for the securing slide, the spring element in the housing has a first indentation and a second indentation, the second indentation being closer to the interior of the housing.

In accordance with yet another feature of the invention, the contact elements are contact bushes (female contacts) or contact pins (male contact pins).

In accordance with a concomitant feature of the invention, the housing has an outer contour, a bottom of the gap, openings for the contact chambers, and two spaced-apart connecting lands disposed in each of the contact chambers, the connecting lands extending from the outer contour as far as the bottom of the gap.

Other features which are considered as characteristic for the invention are set forth in the appended claims.

Although the invention is illustrated and described herein as embodied in a plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
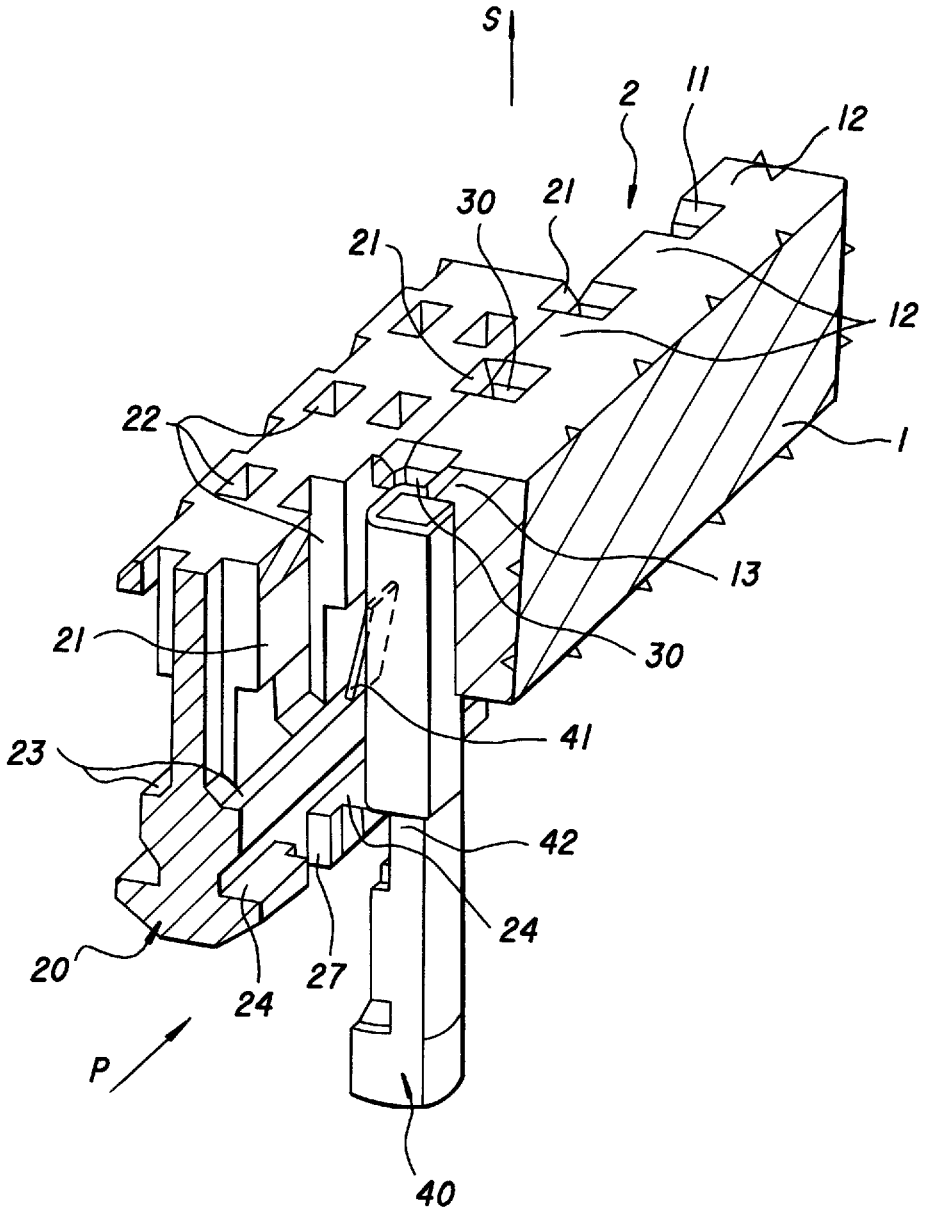
FIG. 1 is a fragmentary, diagrammatic, perspective view of an exemplary embodiment of a plug connector according to the invention with a securing slide, a contact element and a housing.

Referring now to the figures of the drawings in detail and first, particularly, to FIG. 1 thereof, there is seen a fragmentary, perspective view of one possible exemplary embodiment of a plug connector according to the invention. Reference numeral 1 indicates a housing of the plug connector and reference numeral 20 indicates a securing slide that can be inserted into a gap 2 of the housing 1 orthogonally to a plugging direction S. FIG. 1 also shows a contact element 40 that has already been inserted into a contact chamber 30 and is constructed in this case as a female contact or contact bush. As can be seen, the contact chamber 30 is first formed by the insertion of the securing slide 20 into the gap 2. To that end, the housing 1 has slits 11 on its inner wall surface pointing toward the gap 2, and these slits, which are spaced apart from one another, each extend parallel in the plugging direction S. As is seen from above, the slits have a U-shaped cross section. Respective lands 12 between the various slits 11 divide the slits 11 from one another.

These open slits 11 which are oriented toward the securing slide 20 are closed by wall portions 21 on the long sides of the securing slide 20 as the securing slide 20 is inserted. The slits 11, together with the wall portions 21 of the securing slide 20 that close these slits 11, therefore form the contact chambers 30 for the contact elements 40. Every contact chamber 30 is closed off on its upper edge by an encompassing border 13 of the housing 1, which has a smaller diameter than the contact element 40. This is done to avoid allowing the contact elements 40 to protrude from the openings of the contact chambers 30 at the top because the contact elements 40 have been thrust too far into the contact chambers 30.

As is also visible in FIG. 1, the securing slide 20 has an approximately anchor-shaped cross section. Primary detent edges 23 are formed onto the long sides of the securing slide 20 to the left and right, and detent hooks 41 of the contact elements 40 can lock into place in detent fashion on these edges. The primary detent edges 23 preferably extend over the entire width of the securing slide 20. In addition, below each of these two primary detent edges 23 are respective so-called secondary detent protrusions 24, which can engage a contour 42 of the contact element 40 from behind in order to furnish secondary securing, so that the contact element 40 can no longer be pulled out of the contact chamber 30. The individual secondary detent protrusions 24 are spaced apart from one another so far that one contact element 40 can easily be inserted between two adjacent secondary detent protrusions 24. An interstice between two secondary detent protrusions 24 is identified by reference numeral 27.

As FIG. 1 also shows, the securing slide 20 has many longitudinal openings, referred to below as auxiliary openings 22, that extend parallel to the contact chambers 30. These auxiliary openings 22 are aligned with the interstices 27 between the secondary detent protrusions 24 and serve to release the detent hooks or tongues 41 from the primary detent edge 23, by passing a fitting pin through an auxiliary opening 22 and pressing a detent tongue 41 away from a primary detent edge 23.

When the plug connector is assembled, the securing slide 20 is first inserted in the housing 1 into a preliminary position in such a way that the contact element 40 can be inserted into the contact chamber 30 formed by the securing slide 20 and the slit 11. If the contact element 40 is inserted correctly, the detent tongue 41 engages the primary detent edge 23 from behind, so that a primary securing is accomplished. Next, for secondary securing, the securing slide 20 is displaced along the direction of an arrow P, and as a result one of the secondary detent protrusions 24 can engage the contour 42 of the contact element 40 from behind.

Figure 2B:
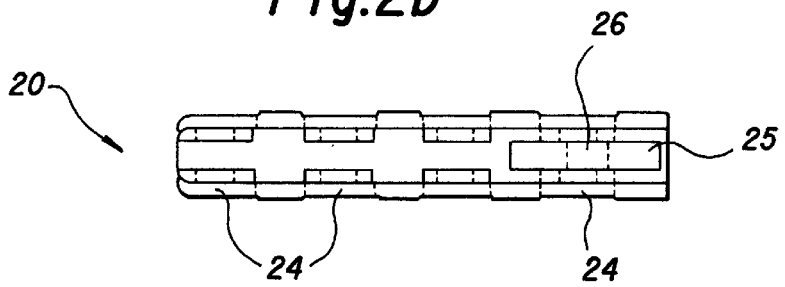
FIG. 2*b* is a bottom-plan view.
Figure 2A:
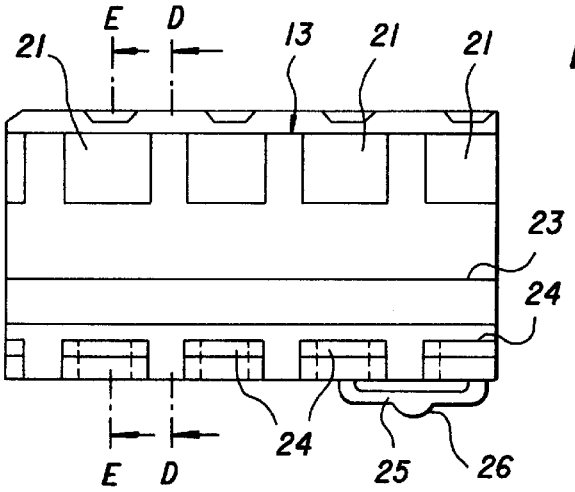
FIG. 2*a* is a side-elevational view.
Figure 2E:
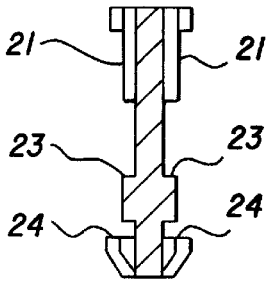
FIG. 2*e* is a sectional view taken along the line E—E of FIG. 2*a,* in the direction of the arrows.
Figure 2F:
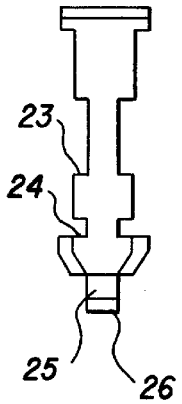
FIG. 2*f* is an end-elevational view of the left-hand side of the securing slide shown in FIG. 1.
Figure 2D:
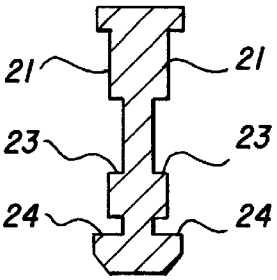
FIG. 2*d* is a sectional view taken along the line D—D of FIG. 2*a,* in the direction of the arrows.
Figure 2C:
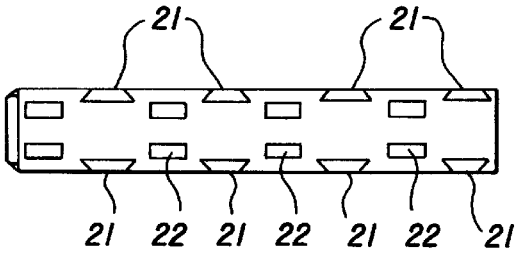
FIG. 2*c* is a top-plan view.

Various views of the securing slide 20 of FIG. 1 are shown in FIGS. 2*a*–2*f*. FIG. 2*a* shows a side view, FIG. 2*b* a view from below, FIG. 2*c* a view from above, and FIGS. 2*d* and 2*e* sectional views through the securing slide 20 of FIG. 2*a* which are taken along respective section lines D—D and E—E. FIG. 2*f* shows an end view of the securing slide as seen from the left-hand side of FIG. 2*a*.

The reference numerals which were already used in FIG. 1 are used again for the same parts in FIGS. 2*a*–2*f*. The wall portions 21 on the two opposed long outer sides of the securing slide 20 which are clearly apparent, represent a wall of the side by side contact chambers 30, in the assembled state of the housing and with the securing slide inserted.

FIGS. 3*a*–3*f* show the housing 1 of the plug connector, which was already shown in part in FIG. 1. The housing is shown in a cross-sectional view in FIG. 3*a*, in a plan view in FIG. 3*b*, in a view from below in FIG. 3*c*, and in sectional views in FIGS. 3*d*, 3*e* and 3*f* respectively taken along the section lines d—d, e—e and f—f of FIG. 3*a*.

As can be seen from FIGS. 2*a*–2*f* and 3*a*–3*f*, the securing slide 20 and the bottom of the gap 2 of the housing 1 have a sliding block guide adapted to one another, in order to keep the securing slide 20 locked in detent fashion inside the housing 1. Openings for the contact chambers 30 of the plug connector are identified by reference numeral 3. As FIGS. 3*a*–3*f* show, a sliding block groove 10 with first and second side by side indentations 14, 15 is made by machining the bottom 4 of the gap 2 for the sliding block guide. This sliding block groove 10 with the indentations 14, 15 cooperates with a hooplike sliding block protrusion 25 on the lower surface of the securing slide 20. The sliding block protrusion 25 has a protruding sliding block nose 26 in its middle, which can engage the aforementioned two indentations 14, 15 of the sliding block groove 10.

If the sliding block nose 26 comes to rest in the first indentation 14, then the securing slide 20 is in its predetent position. However, in this position, the contact elements 40 inserted into the various contact chambers 30, while primarily secured by the aforementioned primary detent edge 23, are not yet secondarily secured. That is not accomplished until the securing slide 20 is inserted into the second indentation 15. These two detent positions are readily apparent for a human operator, since a certain expenditure of force must be made to insert the securing slide 20 into the gap 2 of the housing 1.

Although the sliding block guide described herein in principle can be constructed arbitrarily, it has proved to be expedient to provide one predetent position and one final detent position. In the aforementioned predetent position, the contact elements 40 can already be thrust into the contact chambers 30 and locked in primary fashion, and as a result the contact elements are initially already retained on the basis of each primary detent device. Once the securing slide 20 is inserted all the way into the gap 2 of the housing 1, the final securing of the contact elements 40 is then accomplished.

Figure 3B:
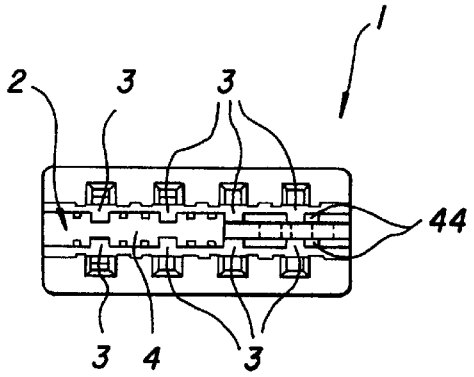
FIG. 3*b* is a top-plan view.
Figure 3A:
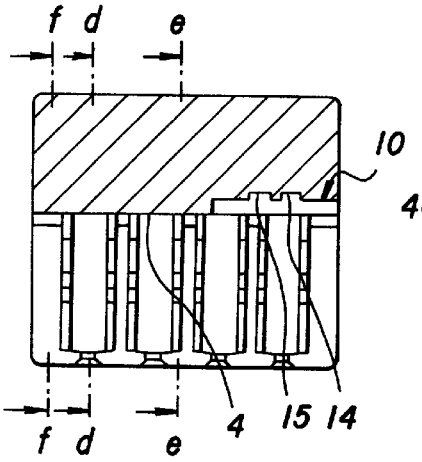
FIG. 3*a* is a cross-sectional view.
Figure 3D:
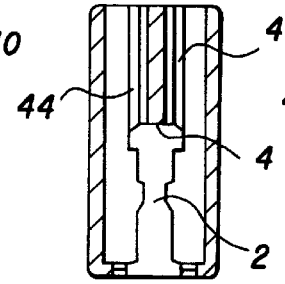
FIG. 3*d* is a sectional view taken along the line d—d of FIG. 3*a,* in the direction of the arrows.
Figure 3E:
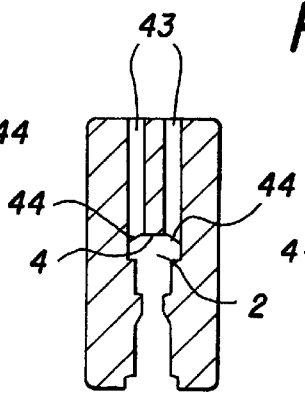
FIG. 3*e* is a sectional view taken along the line e—e of FIG. 3*a,* in the direction of the arrows.
Figure 3F:
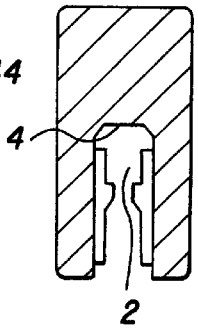
FIG. 3*f* is a sectional view taken along the line f—f of FIG. 3*a,* in the direction of the arrows, of part of the housing shown in FIG. 1.
Figure 3C:
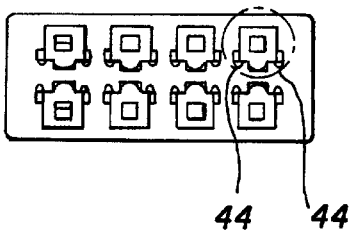
FIG. 3*c* is a bottom-plan view.

As can be seen from FIGS. 3*d* and 3*e*, the housing 1 has channels 43, between which connecting lands 44 are disposed. These connecting lands 44 are integrally formed onto the housing 1 and, beginning at the upper contour of the housing 1 shown in FIGS. 3*d* and 3*e*, they end at the bottom 4 of the gap 2. Each opening 3 is assigned two such spaced-apart connecting lands 44, and the two connecting lands 44 are each disposed on the wall of the respective opening 3 that points toward the middle of the housing. As a result of these connecting lands or pieces 44 in each of the openings 3, it is possible to produce the housing 1 with a simple injection mold, which requires no crosswise slide for inserting the injection molded part in the injection mold.

We claim:

1. A plug connector, comprising:

a housing of insulating material having at least two parallel rows of contact chambers and having a gap formed therein;

contact elements to be inserted into said contact chambers, said contact elements having detent hooks and contours; and a securing slide to be thrust into said gap for securing said inserted contact elements, said securing slide having: two long sides, a multiplicity of detent protrusions disposed on at least one of said long sides orthogonally to a plugging direction of the plug connector for secondary detent securing, said detent protrusions engaging said contours from behind for secondary securing of said contours, said detent protrusions disposed side by side and mutually spaced apart for receiving one of said contact elements thrust between two of said secondary detent protrusions, and a primary detent edge on which said detent hooks rest and lock with said contact elements inserted into said contact chambers, said primary detent edge extending along said two long sides orthogonally to the plugging direction, said primary detent edge extending above and parallel to said detent protrusions.

2. The plug connector according to claim 1, wherein said securing slide has wall portions at said contact chambers, and said securing slide has a multiplicity of auxiliary openings formed therein, oriented in the plugging direction and disposed between said wall portions.

3. The plug connector according to claim 1, wherein said housing has a bottom of said gap pointing in the plugging direction and a sliding block guide at said bottom in which said securing slide can be locked.

4. The plug connector according to claim 3, wherein said securing slide has a lower surface with a sliding block protrusion, and said sliding block guide is a sliding block guide groove in which said sliding block protrusion can be locked.

5. The plug connector according to claim 4, wherein said housing has an interior, a first indentation in said sliding block guide defining a predetent position, and a second indentation closer to said interior defining a final detent position, and said sliding block protrusion has a sliding block nose to be successively locked in said predetent and final detent positions.

6. The plug connector according to claim 1, wherein said contact elements are female contacts.

7. The plug connector according to claim 1, wherein said contact elements are male contact pins.

8. The plug connector according to claim 1, wherein said housing has an outer contour, a bottom of said gap, openings for said contact chambers, and two spaced-apart connecting lands disposed in each of said contact chambers, said connecting lands extending from said outer contour as far as said bottom of said gap.

* * * * *